US008559277B2

(12) United States Patent
Karapatis et al.

(10) Patent No.: US 8,559,277 B2
(45) Date of Patent: Oct. 15, 2013

(54) STRIKING MECHANISM FOR A WATCH OR A MUSIC BOX

(75) Inventors: Nakis Karapatis, Premier (CH); Davide Sarchi, Renens (CH)

(73) Assignee: Montres Breguet SA, L'Abbaye (CH)

( * ) Notice: Subject to any disclaimer, the term of this patent is extended or adjusted under 35 U.S.C. 154(b) by 126 days.

(21) Appl. No.: 13/313,207

(22) Filed: Dec. 7, 2011

(65) Prior Publication Data

US 2012/0147715 A1 Jun. 14, 2012

(30) Foreign Application Priority Data

Dec. 10, 2010 (EP) ..... 10194574

(51) Int. Cl.
*G10K 1/06* (2006.01)
*G04B 25/00* (2006.01)

(52) U.S. Cl.
USPC ..... 368/272; 116/152

(58) Field of Classification Search
USPC ..... 368/267–272; 116/152–154, 150, 155, 116/157
See application file for complete search history.

(56) References Cited

U.S. PATENT DOCUMENTS 3,054,997 A * 9/1962 Steiner ..... 340/392.1
3,121,194 A * 2/1964 Stehlik ..... 335/230
3,127,602 A * 3/1964 Russo et al. ..... 340/392.1
3,869,855 A 3/1975 Sodler
4,097,862 A * 6/1978 Brionne ..... 340/396.1
4,167,849 A 9/1979 Takahashi
5,744,736 A * 4/1998 Chang ..... 84/402
5,886,608 A * 3/1999 Chabay ..... 335/306
6,266,296 B1 7/2001 Miyazawa

FOREIGN PATENT DOCUMENTS

CH 634 455 A3 2/1983
EP 0 963 033 A1 12/1999
FR 1214428 A 4/1960
FR 2 236 223 A1 1/1975

OTHER PUBLICATIONS

European Search Report of EP 10 19 4574 dated Jun. 27, 2011.

* cited by examiner

*Primary Examiner* — Sean Kayes
(74) *Attorney, Agent, or Firm* — Sughrue Mion, PLLC

(57) ABSTRACT

The striking mechanism (1) for a watch or a music box includes a gong (11) fixed to a gong-carrier (12) and an activation member (2) for activating the gong in a striking mode. The striking mechanism includes a first magnetic element (13) arranged on the gong (11) and second magnetic elements (4) arranged on the periphery of the activation member (2), which is a magnetic wheel. In a striking mode, the magnetic wheel is set in rotation at a determined velocity so that the second magnetic elements (4), in the form of moving micro-magnets, move in succession and repeatedly into proximity with and opposite the first magnetic element (13), which is a fixed micro-magnet of opposite magnetic polarity. The rotation of the magnetic wheel sets the gong vibrating via a periodic variation in the magnetic repulsion or attraction force between the moving micro-magnets and the fixed micro-magnet of the gong.

17 Claims, 2 Drawing Sheets

STRIKING MECHANISM FOR A WATCH OR A MUSIC BOX

This application claims priority from European Patent Application No. 10194574.9 filed Dec. 10, 2010, the entire disclosure of which is incorporated herein by reference.

FIELD OF THE INVENTION

The invention concerns a striking mechanism for a watch or a music box. Said mechanism is capable of generating one or several sounds to indicate an alarm or minute repeaters, or a piece of music in the case of a music box. The striking mechanism mainly includes at least one gong fixed to a gong-carrier and a member for activating the vibration of the gong.

BACKGROUND OF THE INVENTION

Within the field of watch-making, a conventional architecture is used to make movements, which are provided with striking mechanisms, such as alarms or minute repeaters. In such embodiments, the gong or gongs used are each formed by a metal wire, which is generally circular in shape and placed in a parallel plane to the watch dial. The metal wire of each gong is generally arranged around the movement, in the watch frame and above a plate on which the various parts of the movement are mounted. One end or several ends of each gong are fixed, for example by soldering, to a gong-carrier integral with the plate, for example, which may be common to all of the gongs. The other end of each gong may generally be free.

The watch striking mechanism includes at least one member for activating the gong, which may be a hammer activated at predetermined times. In this case, the vibration of each gong is generated by the impact of the corresponding hammer on the gong, in particular, in proximity to the gong-carrier. Each hammer makes a partial rotation in the plane of the gong(s) so as to strike the corresponding gong and vibrate it in the plane thereof. Part of the gong vibration is also transmitted to the plate by the gong-carrier.

The mechanical impact between the hammer and the gong of a conventional striking mechanism is difficult to control. The same is true for optimization of acoustic efficiency, which is greatly limited within the audible frequency range, particularly within the range of frequencies between 1 kHz and 4 kHz, but also between 4 kHz and 20 kHz. This is due to the fact that the mechanical impact of the hammer against the gong is of very short duration and most of the energy is transmitted at high frequency vibration modes above 4 kHz. Likewise, the mechanical shock activates almost all of the gong vibration modes, but without allowing any selection of the activated modes. The duration of impact of the hammer against the gong generally cannot be increased by altering the geometry, inertia and material of the parts involved, without also causing a marked decrease in the impact energy. Due to the internal damping and acoustic radiation, the sound cannot be extended without repeating the mechanical shocks. Further, mechanical shocks, particularly the impacts of the hammer against the gong, may lead to spurious noise, especially in the case of double impact, and cause wear of the gong, which constitute drawbacks.

FR Patent No 1 214 428 discloses a striking device for a clock. This striking device includes, in particular, a rotatably mounted hammer, driven by means of an electro-magnet in the direction of a bell, to generate a sound during the mechanical impact of the hammer against the bell. As mentioned hereinbefore, any mechanical impact of the hammer against the bell may also cause spurious noise, which is a drawback.

CH Patent No. 634 455G, which discloses a watch provided with an electroacoustic vibrator, may also be cited. The vibrator includes a vibrating membrane mounted on a shoulder of a support secured to the case, and a coil mounted on a magnetic core, and arranged at a distance underneath the vibrating membrane. An annular magnet is also placed around the coil as part of the magnetic circuit with the magnetic core. A plate made of soft material is secured to the membrane to close the magnetic circuit without any mechanical contact. When a current passes through the coil, a force for activating the membrane is applied to the plate to generate an acoustic signal without any mechanical contact. One drawback of this type of electroacoustic vibrator is that an electrical control device is required to power the coil in order to vibrate said membrane, which requires considerable electric power consumption.

FR Patent Application No. 2 236 223 A1 discloses an acoustic sound generator for a wristwatch. This generator includes a ferromagnetic pin fixed to an inner part of the watch crystal, and an electro-magnet for vibrating said pin. The electro-magnet includes, in particular, a coil arranged in a magnetic circuit provided with permanent magnets. When the coil is powered with electricity, the pin starts to vibrate to generate an acoustic sound. One drawback of this generator is that the coil has to be powered with an alternating current to activate the vibration of said pin and the resonance of the watch crystal, which requires significant electric power consumption.

EP Patent Application No. 0 963 033 A1 discloses a device for generating an acoustic signal in a watch. This device includes a vibrating strip, which is provided with a permanent magnet or a moving steel part, and an activation member, which includes an electro-magnet opposite the permanent magnet of the strip. When the electro-magnet is activated, the vibrating strip starts to vibrate to generate an acoustic signal. As in the preceding documents, the electro-magnet has to be powered by an alternating current in order to vibrate the vibrating strip, using significant electrical power, which is a drawback.

SUMMARY OF THE INVENTION

It is thus an object of the invention to overcome the drawbacks of the state of the art, by providing a striking mechanism for a watch or a music box, which uses a new principle for generating one or several sounds from at least one gong, without any direct mechanical contact between the activating member and the gong in a striking mode.

The invention therefore concerns the aforecited striking mechanism for a watch or a music box, said striking mechanism including at least one gong secured to a gong-carrier, and at least one activation member for activating the gong to vibrate said gong in a striking mode, wherein the striking mechanism includes at least one first magnetic element arranged in one part of the gong, and at least one second magnetic element arranged on the activation member, characterized in that the second magnetic element is a moving permanent magnet, in that in a striking mode the activation member is activated so that the moving permanent magnet repeatedly moves into proximity with and opposite the first magnetic element, which is arranged for generating a magnetic field of opposite polarity to the magnetic field generated by the moving permanent magnet opposite the first magnetic element, so as to vibrate the gong by a repetitive variation in the magnetic repulsion force between the two magnetic elements.

Specific embodiments of the striking mechanism for a watch or music box are defined in the dependent claims 2 to 17.

One advantage of the striking mechanism according to the invention lies in the fact that the gong can be activated via a magnetic arrangement without any direct mechanical contact between the activation member and the gong. The magnetic arrangement may consist of providing the gong with at least one fixed permanent magnet, and the activation member, which may be made in the form of a wheel, with at least one moving permanent magnet. As the wheel rotates, the moving permanent magnet moves into proximity with and opposite the fixed permanent magnet, which may preferably be of opposite magnetic polarity. Once the moving permanent magnet is opposite the fixed permanent magnet, a repulsion force is generated, which activates the vibration of the gong during the rotation of the wheel.

Advantageously, the activation member is a magnetic wheel, capable of being rotatably activated about an axis, which may be perpendicular to the plane or to the rectilinear portion of the gong, or arranged at an angle relative to the plane or to the rectilinear portion of the gong, different from 90°. The gong activation wheel may include several moving permanent micro-magnets, which are arranged regularly or irregularly at the periphery of the activation wheel or several permanently magnetised parts of the wheel made of ferromagnetic material. The rotational velocity of the wheel is capable of determining the vibration frequency of the gong carrying the fixed permanent magnet, which is preferably of opposite magnetic polarity to each moving micro-magnet that faces the fixed permanent magnet.

Owing to the magnetic arrangement for vibrating the gong via the wheel-shaped activation member without any direct mechanical contact, it is possible to select the gong vibration modes which are desired in the striking mode. A pure vibrating gong sound can be extended at will over time, if the rotational velocity of the activation wheel is kept constant at a determined value. The pure gong sound can be selected within the audible frequency range, in particular, between 1 kHz and 4 kHz.

Advantageously, it is possible to obtain magnetic self-regulation of the rotational velocity of the striking mechanism. It is also possible to provide the striking mechanism with shorter gongs than those used for a conventional striking mechanism. With this type of activation wheel fitted with a certain number of permanent magnets, it is no longer necessary to activate said gong using a conventional hammer. Moreover, any spurious noise linked to mechanical shock, and multiple impulses and interference therefrom on the gong vibration, are also eliminated. Several magnetic wheels may also activate the gong in different selected vibration modes according to the different rotational velocity of each wheel and the number of micro-magnets comprised in each wheel. Magnets of alternate polarity may also be placed on the wheel to maximise the transfer of energy to the gong.

Advantageously, the gong may be fitted with one or more magnets, which have the same polarity as the magnets of the wheel, when they are opposite the magnets of the gong. In these conditions, the gong magnets are attracted by those of the rotating wheel. During rotation of the wheel, a force attracting the gong magnets is periodically generated. In this case, if the gong comes into contact with the wheel, the gong can be surface treated to remove noise during contact with the wheel.

BRIEF DESCRIPTION OF THE DRAWINGS

The objects, advantages and features of the striking mechanism for a watch or music box will appear more clearly in the following description, particularly with reference to the drawings, in which.

DETAILED DESCRIPTION OF THE INVENTION

In the following description, all the conventional parts of the striking mechanism for a watch or possibly a music box, which are well known in this technical field, will be only briefly described.

Figure 1:
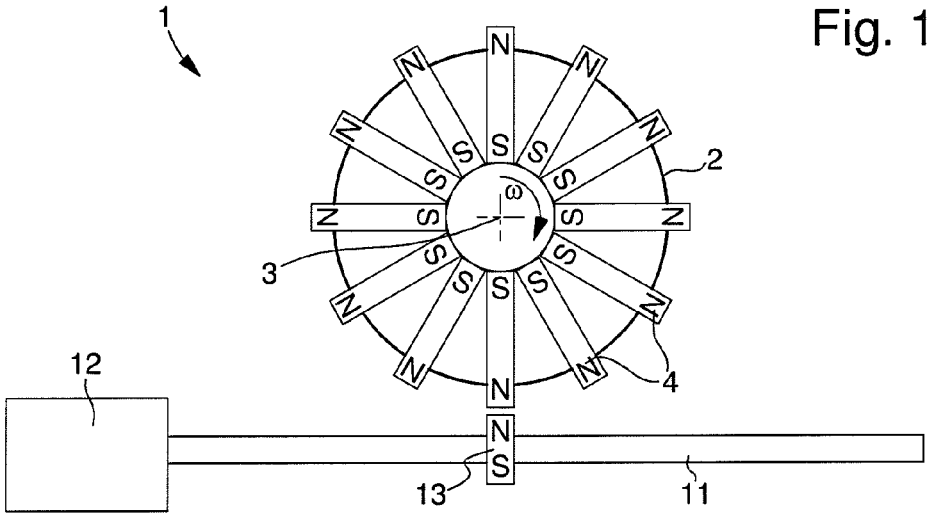
FIG. 1 shows a simplified top view of an embodiment of a watch striking mechanism according to the invention.

FIG. 1 shows a simplified view of a striking mechanism 1 notably for a watch. The striking mechanism first of all includes a gong 11, which is connected, for example, at one end thereof to a gong-carrier 12, whereas the other end is free to move. The gong-carrier may preferably be secured to a plate (not shown) of a watch movement, but it could also be secured to an inner part of the watch case, such as the middle part of the watch case. The striking mechanism also includes a member 2 for activating the gong, which may take the form of an activation wheel rotatably mounted about an axis of rotation 3, which may preferably be mounted on the watch plate. The gong and the activation member include a magnetic arrangement, as explained hereinafter. This enables gong 11 to be made to vibrate, without any mechanical contact with the activation member, to generate one or several sounds, when the activation member is operated in a striking mode.

Gong 11 can be made in the form of a rectilinear portion or a portion of a circle or rectangle or any other geometrical shape. Gong 11 can be made, for example by means of a metal wire, which may be made of a ferromagnetic material (iron, nickel, steel or cobalt), or also of a precious metal or metallic glass. As shown in a simplified manner in the embodiment of FIG. 1, the rectilinear portion of the gong may extend parallel to the plate and to the dial of the watch (not shown). The transverse section of the gong 11 may define a rectangle or preferably a disc with a diameter of less than 0.8 mm.

In order to generate one or several sounds by means of the magnetic arrangement, the gong includes at least one first magnetic element 13, arranged on an intermediate part of the length thereof. This first magnetic element 13 is preferably a fixed permanent magnet 13. This fixed permanent magnet 13 may advantageously be a micro-magnet. This micro-magnet may be bonded or soldered to the gong or inserted in a housing made in the gong material. Two parts of the gong may also be soldered to each side of the micro-magnet. The micro-magnet of the gong may also be made straight in the gong material, which must be in that case ferromagnetic, by a well known magnetizing operation.

For the magnetic arrangement, the activation member, in the form of activation wheel 2, also includes at least one second magnetic element 4, arranged at the periphery of the wheel. This second magnetic element 4 is arranged on wheel 2 so as to be able to generate a magnetic field of opposite polarity to the magnetic field generated by the first magnetic element 13, when the second magnetic element 4 comes into proximity with and opposite the first magnetic element in a striking mode. This second magnetic element 4 is a moving permanent magnet, which may advantageously be a moving micro-magnet.

Preferably, activation wheel 2 includes several micro-magnets arranged at the periphery of the wheel. These moving micro-magnets 4 are preferably regularly distributed on the periphery of the wheel, and are each of the same or different size to the fixed micro-magnet 13 of gong 11. Each moving micro-magnet is preferably arranged equidistant from the centre of the activation wheel, and slightly overhanging or flush with the peripheral edge of said wheel. There may be for instance N number of moving micro-magnets, for example 12 micro-magnets, regularly distributed at an angular distance of 30°.

Each moving micro-magnet may have the same magnetization value, but it is also possible for the value of each moving micro-magnet not to be equal. These moving micro-magnets 4 may be bonded or soldered to the periphery of activation wheel 2 or inserted in a housing made in the wheel material. These moving micro-magnets 4 may also be made straight in the material of the wheel by a well known local magnetising operation. However, in that case the material must be ferromagnetic.

Moving micro-magnets 4 are each capable of moving in succession into proximity with and opposite the fixed micro-magnet 13 of the gong, with an opposite magnetic polarity to the fixed micro-magnet 13, when the wheel rotates in the striking mode. The moving micro-magnets may be arranged on the wheel so that their north pole is pointing towards the exterior of the wheel and their south pole is pointing towards the centre of the wheel. Under these conditions, the north pole of fixed micro-magnet 13 of the gong points in the direction of the centre of the activation wheel. However, it is also possible to envisage the opposite arrangement, with the south poles of the moving micro-magnets pointing towards the exterior to enable them to move respectively opposite the south pole of the fixed micro-magnet 13 of the gong.

When the wheel is rotating about axis of rotation 3, a maximum magnetic repulsion force is generated when each moving micro-magnet moves exactly opposite fixed micro-magnet 13 at a distance which may be on the order of 5 μm, or slightly smaller or greater. This distance may be the same for each moving micro-magnet. However, the magnetic repulsion force is minimal when two moving micro-magnets 4 of the wheel are equidistant from fixed micro-magnet 13 of gong 11. The variation in the magnetic repulsion force is thus periodic during the rotation of activation wheel 2. Thus, depending upon the rotational velocity ω imposed on the wheel, it is possible to vibrate the gong in a selected vibration mode.

It is to be noted that the repulsion force of each moving micro-magnet of the wheel moving opposite the fixed micro-magnet of the gong is increased according to the power of 4 of the distance in local dipolar approximation (therefore if the magnets are small relative to their distance). The repulsion becomes 16 times greater when the distance separating the two micro-magnets is divided by two. If one of moving micro-magnets 4 moves closer, to a distance, for example, close to 1 μm to vibrate the gong, the magnetic force may be on the order of 1 N. However, as indicted hereinbefore, normally the minimum distance separating each moving micro-magnet 4 facing the fixed micro-magnet 13 during the rotation of the activation wheel, may be on the order of 5 μm. This distance may also be slightly smaller or greater so as to generate a continuous and sufficient gong vibration. These permanent micro-magnets may be made with a size of 1 $mm^3$ or less, generating a magnetic field of less than 1200 Gauss.

By a suitable adjustment of the rotational velocity ω of activation wheel 2, it is possible for the variation frequency of the magnetic repulsion force to be in resonance with a natural vibration frequency of the gong. The energy is thus mainly transferred on this natural frequency according to the selected rotational velocity of activation wheel 2. As long as activation wheel 2 is rotating at the selected velocity, the gong continues vibrating at a specific natural frequency without any damping of the product thereof. The intensity of the sound may also be adjusted by moving magnetic wheel 2 further away from or closer to the gong, which increases or decreases the distance separating each moving micro-magnet facing the fixed micro-magnet 13 of gong 11. Moreover, when a vibration of gong 11 is generated by periodic magnetic impulses, any spurious noise due to mechanical shocks is eliminated.

To adjust the rotational velocity of the activation wheel, a standard braking method could be used, or an eddy current braking method, or self-adjustment of the wheel-gong assembly via a magnetic escape mechanism. The magnetic repulsion, which leads to the vibration of gong 11, may also enable adjustment of the rotational velocity of activation wheel 2, if the inertia of said wheel is comparable to the inertia of the gong. Gong 11 and activation wheel 2 with their magnetic elements 4, 13, may be dimensioned to simultaneously set the rotational velocity of the activation wheel and the vibration frequencies of gong 11.

According to a variant of the striking mechanism that is not shown, several magnetic activation wheels may be provided for gong 11. Gong 11 may also include more than one magnetic element in the form of a fixed permanent magnet, or the entire length of the gong may be magnetized, if it is made of a ferromagnetic material. Each magnetic wheel includes an equal or different number of micro-magnets for each wheel, with a different or equal magnetization value of the micro-magnets on the activation wheels. The activation wheels may have axes of rotation that are parallel or arranged at a certain angle in relation to each other. The activation wheels may be set in rotation at different rotational velocities and also at different times in a striking mode. The repulsion force generated in fixed micro-magnet 13 of gong 11 varies periodically and differently as a function of the rotation of one or other of the rotating activation wheels. The gong may be selected to vibrate at several specific natural frequencies according to the number of magnetic wheels 2 set in rotation in the striking mode. The gong vibration modes may be selected within the preferred frequency range between 1 kHz and 4 kHz.

In an alternative embodiment according to the same principle, the micro-magnets, which are arranged on the wheel and the gong, have matching polarity. This leads to the attraction of a moving magnet of the wheel facing at least one fixed magnet of the gong. In such case, the gong is activated when at least one fixed micro-magnet of the gong is opposite at least one micro-magnet of the rotating wheel. Conversely, the gong is released when the moving micro-magnet of the wheel moves away. Even in this case, a periodic and continuous transfer of energy exists between the wheel and the gong.

Shocks between the wheel and the gong cannot, however, be excluded, which means a surface treatment of the gong is required to prevent any noise and any fretting wear.

Figure 2:
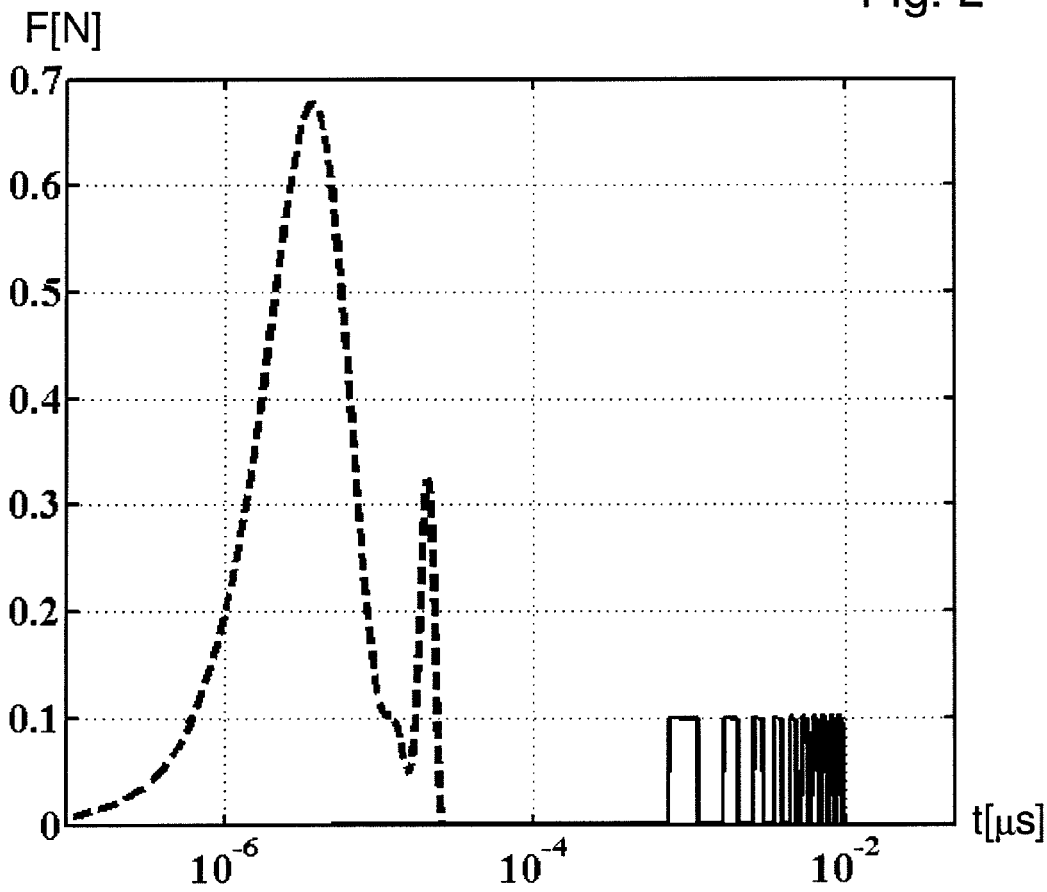
FIG. 2 shows a comparative graph of the force applied to the gong over time when there is a mechanical impact of a hammer against the gong or when there is a repetitive magnetic force generated by the rotation of the magnetic activation wheel of a striking mechanism according to the invention.
Figure 3:
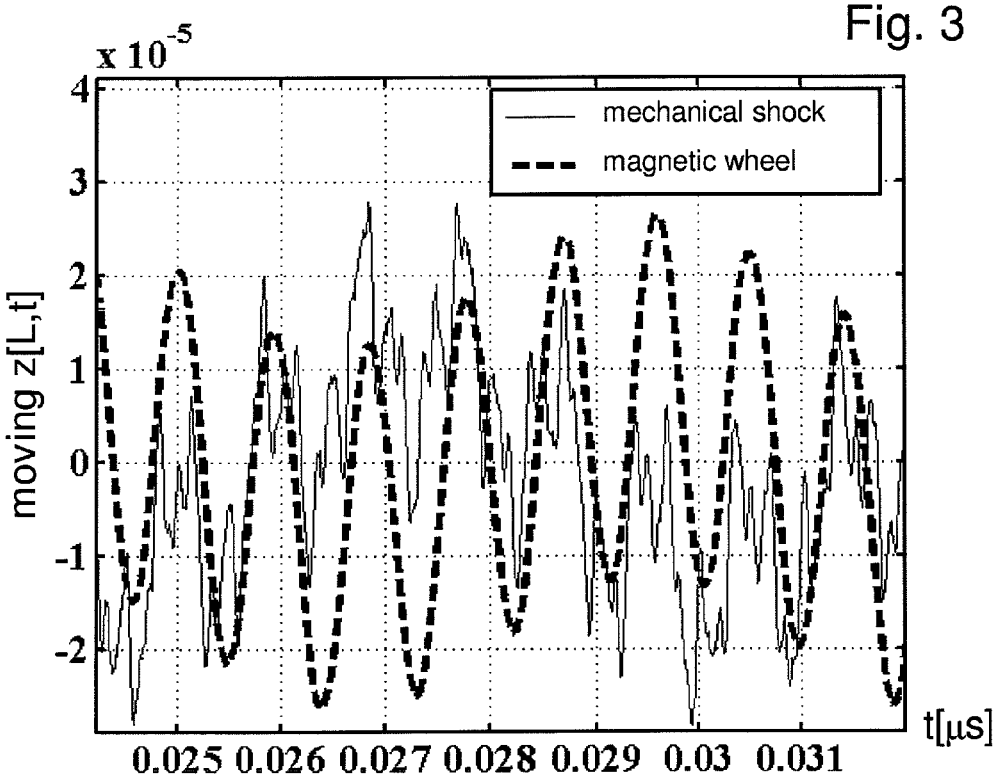
FIG. 3 is a comparative graph of the vibration at the end of the gong in the case of a mechanical shock from a hammer against the gong or in the case of a periodic vibration of the gong via the rotation of the magnetic wheel of the striking mechanism according to the invention.
Figure 4:
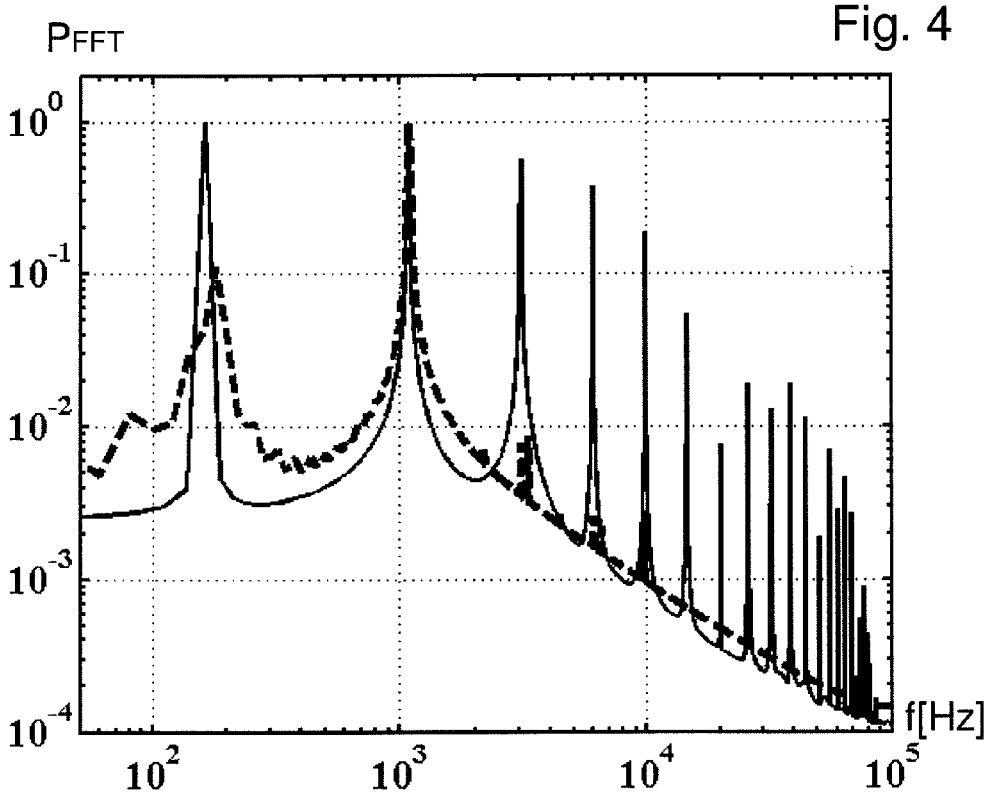
FIG. 4 shows a comparative graph of the amplitude of the standardized partials in the gong vibration generated by a mechanical impact or by periodic magnetic impulses according to the oscillation frequency.

Reference can be made to FIGS. 2 to 4 for a comparison between a conventional striking mechanism and the striking mechanism of the present invention, FIG. 2 shows the graph of the force acting on the gong over time for a mechanical shock, when the hammer strikes the gong in a conventional striking mechanism, and for one or several magnetic impulses of a striking mechanism according to the invention. The curve for the mechanical shock is shown in dotted lines, whereas the curve for the periodic magnetic repulsion force of the rotating magnetic wheel is shown in full lines.

For this comparative graph, the gong is dimensioned with a length L equal to 5 cm. The rotational velocity of the magnetic activation wheel is set at 200 rads per second and the number N of moving micro-magnets of the wheel is equal to 36. The distance between the gong and the wheel is close to 10 μm. The mechanical impulse of the conventional striking mechanism is of very short duration, on the order of 30 μs, whereas for the magnetic wheel-gong assembly, it is possible to produce a practically periodic repulsion force of selected duration. In this case, the wheel has been selected to rotate for a period of 0.01 seconds. The profile of the magnetic impulses is almost square, given that the magnetic repulsion force is practically constant, if the wheel is within an angular interval of 3° around the angular position that corresponds to the maximum repulsion force.

FIG. 3 shows a comparative graph of the development over time of the vibration at the free end of the gong for the magnetic wheel-gong assembly and for a conventional mechanical shock. The curve in dotted lines represents the periodic magnetic impulses, whereas the curve in full lines represents at least one mechanical shock. The periodicity of the gong vibration produced by the magnetic impulses generated by the rotating magnetic wheel is clearly shown for the dotted line curve.

FIG. 4 shows the amplitude of the standardised partials following a quick Fourier transform according to the oscillation frequency of the gong, for a conventional striking mechanism and for a striking mechanism according to the invention. The gong vibrations are formed of partials, which are produced either by the mechanical shock to the gong, or by the periodic magnetic impulses. The curve in dotted lines represents the periodic magnetic impulses, whereas the curve in full lines represents at least one mechanical shock.

In the case of the periodic magnetic impulses, the energy is transferred above all in the 1 kHz vibration mode, which represents 65% of the total energy, whereas 20% of the energy is transferred in the lower frequency modes. Given that the rotational velocity of the magnetic wheel has been set to vibrate the gong mainly at the frequency of 1 kHz, most of the energy is transferred relatively well at this vibration frequency of 1 kHz. This is totally different from vibration modes following a mechanical shock, in which several peaks are observed between 1 kHz and 20 kHz and above. This clearly shows that the transfer of energy in at least one of the low frequency gong vibration modes is maximised with the magnetic arrangement of the striking mechanism of the invention. Any spurious noise is also eliminated.

Instead of using permanent micro-magnets, it is also possible to envisage using one or several coils, which can each be connected to a continuous current to generate a magnetic field of determined polarity, as the magnetic elements on the activation wheels and/or on the gong. Each coil may also be arranged to be disconnected from the continuous current source in an idle mode of the striking mechanism.

From the description that has just been given, several variants of the watch striking mechanism can be devised by those skilled in the art without departing from the scope of the invention defined by the claims. A median part of the gong may be secured to a gong-carrier integral with the plate or the middle part of the watch. The striking mechanism may include several gongs each activated by a respective magnetic activation wheel. Depending upon the number of gongs used, they may form a pin barrel for generating musical notes by rotating each magnetic wheel at determined times. The moving micro-magnets of the activation wheel may be irregularly distributed at the periphery of the wheel and with a different magnetization value for certain micro-magnets. These moving micro-magnets may be distributed at the periphery of the wheel so that certain moving micro-magnets are at a different distance from the centre of the wheel than other moving micro-magnets. The direction of magnetic polarisation of the micro-magnets of each magnetic wheel may, alternatively, be different, to ensure a combination of the repulsion force and the attraction force during the rotation of the magnetic wheel. There may also be a combination of a magnetic wheel and a hammer with a permanent magnet for magnetically vibrating the gong or gongs of the striking mechanism at different times. The axis of rotation of the magnetic activation wheel may also be arranged parallel to the rectilinear portion of the gong with a fixed permanent magnet or at a determined angle relative to the rectilinear portion of the gong. The moving permanent magnet of the activation member may be periodically moved in a rectilinear manner towards the fixed permanent magnet of the gong, or take the form of a pendulum with a determined oscillation frequency.

The invention claimed is:

1. A striking mechanism for a watch or a music box, said striking mechanism including at least one gong secured to a gong-carrier, and at least one activation member for activating the gong to vibrate said gong in a striking mode, wherein the striking mechanism includes at least one first magnetic element arranged in one part of the gong, and at least one second magnetic element arranged on the activation member, wherein the second magnetic element is a moving permanent magnet, wherein in a striking mode the activation member is activated so that the moving permanent magnet repeatedly moves into proximity with and opposite the first magnetic element, which is arranged for generating a magnetic field of opposite polarity to the magnetic field generated by the moving permanent magnet opposite the first magnetic element, so as to vibrate the gong by a repetitive variation in the magnetic repulsion force between the two magnetic elements.

2. The striking mechanism according to claim 1, wherein the first magnetic element of the gong is a fixed permanent magnet.

3. The striking mechanism according to claim 2, wherein the fixed permanent magnet is a fixed micro-magnet.

4. The striking mechanism according to claim 1, wherein the moving permanent magnet is a moving micro-magnet.

5. The striking mechanism according to claim 1, wherein the first magnetic element is a coil capable of being connected to a continuous current source for generating a magnetic field of determined polarity so as to generate a magnetic repulsion force or a magnetic attraction force, when the two magnetic elements are in proximity with and opposite each other.

6. The striking mechanism according to claim 1, wherein the activation member is a magnetic wheel with the moving permanent magnet arranged at the periphery of the magnetic wheel, and wherein during the rotation of the magnetic wheel in the striking mode, the rotating, moving, permanent magnet is capable of generating a periodic variation in the magnetic repulsion force of the two magnetic elements upon each passage into proximity with and opposite the first magnetic element of opposite magnetic polarity, in order to vibrate the gong.

7. The striking mechanism according to claim 6, wherein the magnetic wheel includes several moving permanent magnets which are arranged at the periphery of the wheel and are capable of each moving in succession into proximity with and opposite the first magnetic element during the rotation of the magnetic wheel, to generate a periodic variation in the magnetic repulsion force in order to vibrate the gong.

8. The striking mechanism according to claim 7, wherein the second magnetic elements are moving micro-magnets, arranged at the periphery of the magnetic wheel, and placed slightly overhanging or flush with the peripheral edge of the magnetic wheel.

9. The striking mechanism according to claim 8, wherein the moving micro-magnets are of the same dimensions and are all arranged at the same distance from the centre of the magnetic wheel.

10. The striking mechanism according to claim 8, wherein the moving micro-magnets are regularly distributed on the periphery of the magnetic wheel.

11. The striking mechanism according to claim 8, wherein each moving micro-magnet, which is opposite the first magnetic element of the gong, which is a fixed micro-magnet, is at a suitable distance comprised between 1 μm and 20 μm, preferably at a distance on the order of 5 μm, and wherein the striking mechanism is provided for adapting the distance between the magnetic wheel and the gong so as to adapt the variation amplitude of the magnetic repulsion force or magnetic attraction force, and the sound generated by the vibrating gong.

12. The striking mechanism according to claim 6, wherein the magnetic wheel is arranged to be driven in rotation at a selected rotational velocity so that the gong vibrates continuously and mainly at a determined vibration frequency within an audible frequency range.

13. The striking mechanism according to claim 12, wherein the adjustment of the rotational velocity of the magnetic wheel is obtained by self-regulation of the wheel-gong assembly via a magnetic escape mechanism.

14. The striking mechanism according to claim 6, wherein it includes several magnetic wheels, which each include a determined and different number of moving micro-magnets as the second magnetic elements, which are distributed on the periphery of each wheel, wherein each magnetic wheel is arranged at a certain distance from the first magnetic element of the gong, and wherein each magnetic wheel is arranged to rotate at a different rotational velocity so as to vibrate the gong continuously in several selected vibration modes.

15. The striking mechanism for a watch or a music box, said striking mechanism including at least one gong secured to a gong-carrier, and at least one activation member for activating the gong to vibrate said gong in a striking mode, wherein the striking mechanism includes at least one first magnetic element arranged in one part of the gong, and at least one second magnetic element arranged on the activation member, wherein the second magnetic element is a moving permanent magnet, and wherein in a striking mode the activation member is activated so that the moving permanent magnet repeatedly moves into proximity with and opposite the first magnetic element, which is arranged for generating a magnetic field of the same polarity as the magnetic field generated by the moving permanent magnet opposite the first magnetic element, so as to vibrate the gong by a repetitive variation in the magnetic attraction force between the two magnetic elements.

16. The striking mechanism according to claim 15, wherein the activation member is a magnetic wheel with the moving permanent magnet arranged at the periphery of the magnetic wheel, and wherein during the rotation of the magnetic wheel in the striking mode, the rotating, moving, permanent magnet is capable of generating a periodic variation in the magnetic attraction force of the two magnetic elements upon each passage into proximity with and opposite the first magnetic element having the same magnetic polarisation, in order to vibrate the gong.

17. The striking mechanism according to claim 16, wherein the magnetic wheel includes several moving permanent magnets, which are arranged at the periphery of the wheel and are capable of each moving in succession into proximity with and opposite the first magnetic element during the rotation of the magnetic wheel, to generate a periodic variation in the magnetic attraction force in order to vibrate the gong.

* * * * *